US005165889A

United States Patent [19]

Baggott

[11] Patent Number: 5,165,889

[45] Date of Patent: Nov. 24, 1992

[54] GAS CONVECTION OVEN WITH HEAT EXCHANGER AND BAFFLES

[75] Inventor: George T. Baggott, Cleveland, Ohio

[73] Assignee: Import-Export Research and Development, Inc., Cleveland, Ohio

[21] Appl. No.: 354,613

[22] Filed: May 19, 1989

[51] Int. Cl.[5] ..... F24C 15/32; F27D 7/04

[52] U.S. Cl. ..... 432/152; 432/199; 126/21 A; 126/91 A

[58] Field of Search ..... 432/147, 152, 175, 176, 432/199, 200, 201, 202, 209; 126/21 A, 91 A

[56] References Cited

U.S. PATENT DOCUMENTS

| | | | |
|---|---|---|---|
| 3,324,844 | 6/1967 | Huffman | 126/21 A |
| 3,590,803 | 7/1971 | Sauer | 126/21 A |
| 3,605,717 | 9/1971 | Sauer | 126/21 A |
| 3,719,180 | 3/1973 | Pere | 126/21 A |
| 3,926,106 | 12/1975 | Deusing et al. | 126/21 A X |
| 4,484,561 | 11/1984 | Baggott et al. | 432/199 X |
| 4,529,379 | 7/1985 | DiCastri | 432/147 X |

*Primary Examiner*—Albert J. Makay
*Assistant Examiner*—Christopher B. Kilner
*Attorney, Agent, or Firm*—Renner, Otto, Boisselle & Sklar

[57] ABSTRACT

A convection oven comprises a heating compartment, a burner for effecting combustion of gas, a heat exchanger for conducting therethrough the products of combustion of gas initiated at the burner, first and second blowers for blowing air past the heat exchanger and into the heating compartment for heating the compartment, upper and lower blowers each having an inlet through which air is drawn into the blowers from a common side of the heating compartment for recirculation past the heat exchanger, and the heat exchanger having first and second outlets for the combustion products respectively disposed in front of the inlets of the upper and lower blowers. Each outlet is located to direct the combustion products towards a lower region of the inlet of the respective blower. The heating compartment has vertical walls extending generally perpendicular to the one side of the heating compartment, and respective baffles are spaced inwardly from the vertical walls and define therewith air plenum chambers into which is directed air from the heat exchanger. The baffles have therein a plurality of openings for passage of air from the plenums into an interior space located between the baffles, and the plenum chambers are substantially closed at their ends furthest from the heat exchanger to restrict flow of air around the baffles at the ends further from the heat exchanger.

18 Claims, 5 Drawing Sheets

GAS CONVECTION OVEN WITH HEAT EXCHANGER AND BAFFLES

TECHNICAL FIELD

The present invention relates generally to gas convection ovens and, more particularly, to improvements in a gas convection oven of the type disclosed in U.S. Pat. No. 4,484,561 which is particularly useful in restaurants, cafeterias and the like for food preparation. Said U.S. Pat. No. 4,484,561 is hereby incorporated herein by reference.

BACKGROUND

In commercial applications for food heating it is desirable to provide relatively large heating compartments for containing food intended for cooking, baking, frying, thawing, etc. It is desirable that heat in such heating compartments be relatively uniformly distributed throughout the compartment for uniform or controlled heating of food products therein. It is desirable, too, that the entire appliance, i.e., a gas convection oven, be capable of being cleaned with relative ease in order to maintain high standards of cleanliness. It also is important to maintain a high degree of reliability of the equipment and facility of servicing the same.

In U.S. Pat. No. 3,605,717 there is disclosed a convection oven in which combustion of gas effects the primary heat input. In such patent there is disclosed principles of convection heating in a commercial heating appliance.

Food placed inside a convection oven is processed by moving heated air along a circulatory path directed and arranged to provide throughout the heating chamber substantially uniform temperature of a preselected and controllable level. The circulatory path is generally defined by the walls of the oven, by baffling and by food supporting devices in the food chamber. The air is moved along the circulatory path by a blower usually located adjacent the food chamber in a convection blower chamber. The blower normally is in the circulatory path.

In the past, the circulated air in convection ovens has been heated by passing the air over and around a tube-like heat exchanger such as that used in the convection oven shown in the above noted U.S. Pat. No. 3,605,717. In such convection oven, the products of combustion may enter the circulatory air path of the convection oven but this occurs at a limited outlet area of the convection blower air flow. The heat exchanger tube disclosed in such patent has several linear tube sections connected together at angles to extend generally parallel to several of the walls of the convection blower chamber so that air blown by the convection blower would flow across at least several of those linear tube sections to be heated by the hot gases flowing through the tube sections. A conical inlet baffle guides air from the heating or food chamber toward the center or inlet of the convection blower wheel, and a perimeter portion of such baffle and the oven walls guide air flow from the outlet of the convection blower wheel, as such air flows past the heat exchanger, into the heating compartment. Baffles on walls of the heating compartment and the oven walls further guide air flow toward the food or the material therein.

More recently, U.S. Pat. No. 4,484,561 disclosed a convection oven employing a novel form of heat exchanger for conducting therethrough the products of combustion from a power gas burner. The heat exchanger includes a first tubular section relatively proximate the burner and having a surface area configuration of a shape and position with respect to air flowing from the oven blower to draw air blown thereacross so as to flow across substantially the entire extent of such surface area configuration.

BRIEF SUMMARY OF THE INVENTION

The present invention provides for improved heating performance in gas convection ovens. More particularly, and according to one aspect of the invention, a convection oven comprises a heating compartment, a burner for effecting combustion of gas, a heat exchanger for conducting therethrough the products of combustion of gas initiated at the burner, first and second blowers for blowing air past the heat exchanger and into the heating compartment for heating the compartment, the first and second blowers each having an inlet through which air is drawn into the blowers from the heating compartment for recirculation past the heat exchanger, and the heat exchanger having first and second outlets for the combustion products respectively disposed in front of the inlets of the first and second blowers.

As is preferred, each outlet is located to direct the combustion products towards a lower region of the inlet of the respective blower. The first and second blowers are vertically spaced apart along a common side of the heating compartment, and the heat exchanger includes a tubular exhaust section spanning the inlets of the first and second blowers. Each outlet includes an exhaust vent nozzle for directing combustion products from an opening in the tubular exhaust section towards the inlet of the respective blower.

According to another aspect of the invention, a convection oven comprises a heating compartment, a burner for effecting combustion of gas, a heat exchanger for conducting therethrough the products of combustion of gas initiated at the burner, a blower for blowing air past the heat exchanger and into the heating compartment for heating the compartment, the blower having an inlet at one side of the heating compartment through which air is drawn into the blower from the heating compartment for recirculation past the heat exchanger, the heating compartment having vertical walls extending generally perpendicular to the one side of the heating compartment, respective baffles spaced inwardly from the vertical walls and defining therewith air plenum chambers, and means for directing air passing over the heat exchanger into the plenum chambers, the baffles having therein a plurality of openings for passage of air from the plenums into an interior space located between the baffles, and the plenum chambers being substantially closed at their ends furthest from the heat exchanger to restrict flow of air around the baffles at the ends furthest from the heat exchanger.

According to a further aspect of the invention, a convection oven comprises a heating compartment, a burner for effecting combustion of gas, a heat exchanger for conducting therethrough the products of combustion of gas initiated at the burner, a blower for blowing air past the heat exchanger and into the heating compartment for heating the compartment, the blower having an inlet through which air is drawn into the blower from the heating compartment for recirculation past the heat exchanger, and the heat exchanger having an outlet for the combustion products located to direct the combustion products towards a lower region of the inlet of the blower.

The foregoing and other features of the invention are hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION OF THE INVENTION

Figure 1:
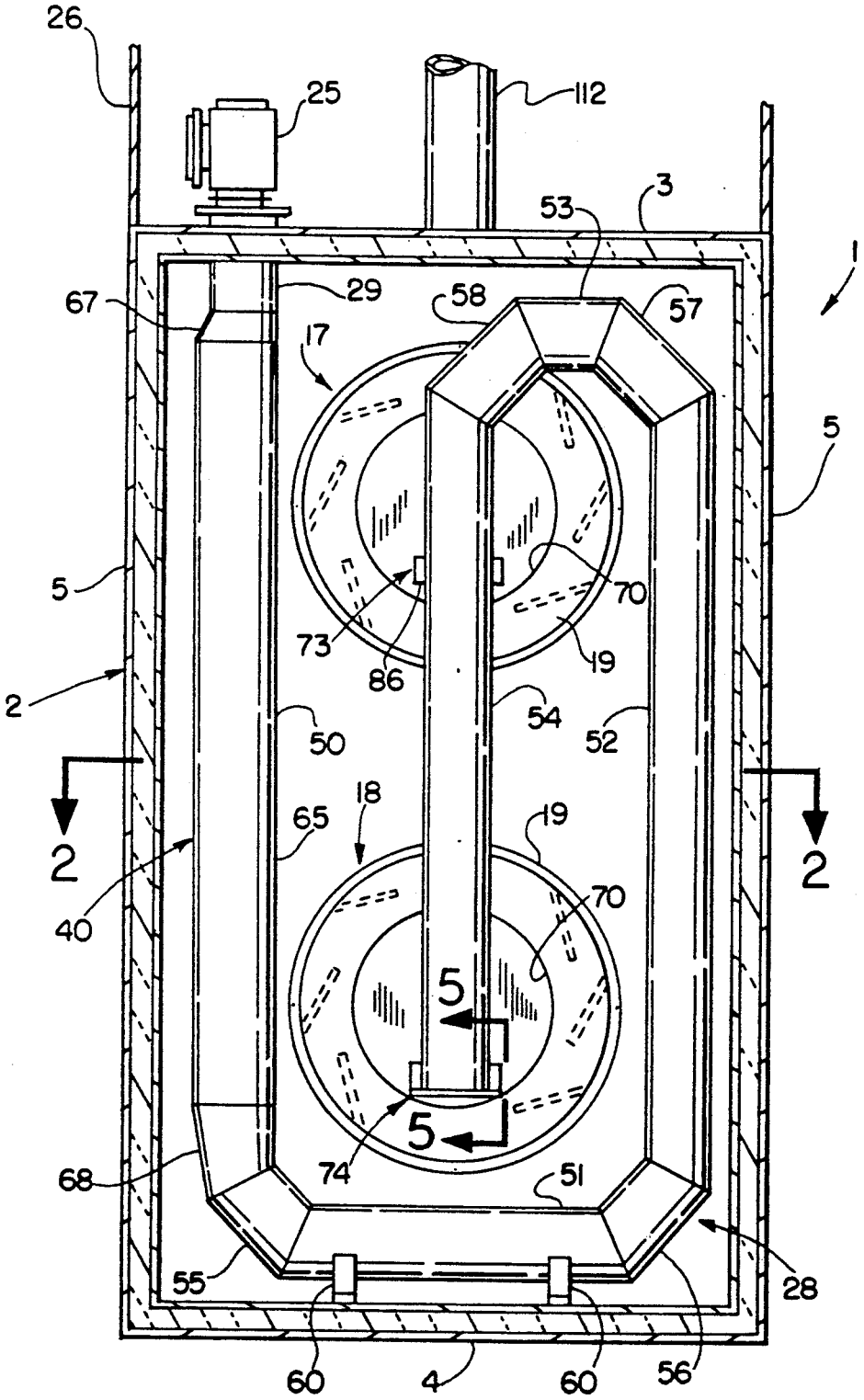
FIG. 1 is a vertical sectional view through a gas convection oven according to the invention.

Referring now in detail to the drawings and initially to FIGS. 1–4, a gas convection oven in accordance with the present invention is generally indicated at 1. The oven 1 generally corresponds in construction to an oven sold by Crescent Metal Products Inc. of Cleveland, Ohio under Model CXO-4935-GA, except in regard to improvements hereinafter described in detail.

The oven 1 is formed by a box-like housing 2 having well insulated top, bottom, side and end walls 3, 4, 5 and 6, respectively. The space within the housing 2 is divided into a relatively large heating/food processing compartment or chamber 7, which takes up a substantial part of the total interior space of the oven 1, a convection blower/heat exchanger chamber 8, and an equipment chamber 9. A wall 10 divides the equipment chamber from the convection blower/heat exchanger compartment 8, and there is a partial separation of the latter and the heating compartment 7 provided by an air inlet baffle 11. The wall 10 preferably is insulated to protect the motor and/or other equipment and controls contained in the equipment chamber 9 from the high temperatures normally present in the other two chambers. As may be desired, end wall 6 at equipment chamber 9 may be uninsulated as shown.

Food to be processed is conveniently placed in the heating chamber 7 through an oven door 12. In the illustrated embodiment a roll-in rack is used to support trays containing food. Preferably the trays are spaced apart to permit heated air and gases to be freely and uniformly circulated over, around, and about all the food products being processed. It is desirable to provide and to maintain all of the food at a relatively uniform temperature, and proper arrangement of the trays or similar means contributes to this result. Furthermore, openings 13 in side wall baffles 14 and 15 positioned in the heating chamber 7 to direct air flow from the convection blower compartment 8 into the heating chamber helps control air/temperature distribution in the heating chamber 7, as is further discussed below.

The flow of heated air and gases to process the food is provided by upper and lower convection blowers 17 and 18 each having a conventional blower wheel 19 driven by an electric motor 20. The motor 20 of each blower is mounted on the wall 10 in the equipment chamber 9. The motor shaft extends through the wall 10 and supports the wheel 19 centrally of side walls 5.

The flow of air provided by the blowers is directed in a circulatory path that traverses both the heating chamber 7 and the convection blower/heat exchange chamber 8. More particularly, air leaving the wheel 19 of each blower generally in a radial flow direction is directed along the front and back sides of the heating chamber 7 and toward the opposite end of the latter relative to the convection blower wheels via side plenums 21 and 22 formed between the side walls 13 and respective baffle plates 14 and 15. The baffle plates 14 and 15 are spaced from and parallel to the adjacent walls and are preferably supported on posts 23 or other means. The baffle plate 14 is supported on the back wall of the heating chamber 7 and the baffle plate 15 is supported on the door 12 which forms substantially the front wall of the heating chamber 7. The baffle plates 14 and 15 are parallel and spaced from each other and, accordingly, accommodate in the space therebetween a roll-in rack for supporting food to be processed in the heating chamber 7. As discussed in greater detail below with reference to FIGS. 7–11, the baffles 14 and 15 are provided with an array of openings for passage of air from the plenums 21 and 22 into the interior or central portion of the heating chamber for flow across the food being heated.

The air circulation path is directed back from heating chamber 7 to the blowers 17 and 18 by respective conical inlet baffles 11 placed between the heating chamber 7 and blower chamber 8. The conical central portion 24 of each baffle 11 directs air circulation into the axial air inlet of the respective blower wheel 19, completing the air circulatory flow path.

Heat is preferably provided for the gas convection oven 1 by a power gas burner 25. The gas burner may be provided as an integral package that can be mounted externally of the chambers 7 and 8 and safely housed within a burner housing 26 at the top of the oven 1. The gas burner may include a pre-mix system that mixes gas and air, pressure controls, a power fan, various electronic controls, electric combustion ignition, and other safety, control and efficiency features.

The outlet of the burner 25 is coupled directly to a heat exchanger 28 at an intake tube section 29. The power gas burner may be periodically ignited and shut down under control of a conventional thermostat control including a heat sensor located in or proximate to the chambers 7 and 8.

The heat exchanger 28, which is seen most clearly in FIGS. 1–4, primarily consists of a tube 40 through which the hot flame and gas products of combustion derived from flame produced by the gas/air mixture emanating from the power gas burner 25 may flow. Such flame and gas products of combustion effect heating of the heat exchanger tube 40, which is positioned in the path of air flow from the convection blowers 17 and 18 into the heating chamber 7 thereby to heat such flowing air. Due to the high intensity and substantial heat produced by the gas combustion at the outlet of the power gas burner 25, the heat exchanger tube 40 preferably is formed of stainless steel or other high temperature withstanding material.

The heat exchanger tube 40 is of a generally spiral shape having respective linear sections joined at angular corner sections with the respective linear sections being positioned parallel and relatively adjacent the front and back side walls, bottom wall, and a portion of the top wall of the convection blower chamber 8. The heat exchanger tube 40, more particularly, includes generally linear sections 50, 51, 52 and 53 and an exhaust tube section 54. Mitred 45° angle elbow joints 55, 56, 57 and 58 join respective adjacent linear portions of the heat exchanger tube, as is best seen in FIG. 1. The heat exchanger tube 40 is relatively securely mounted in the convection blower chamber 8 by various mounting brackets, some of which are shown at 60.

The heat exchanger tube for the most part may be circular in cross-section and of uniform diameter. However, at the inlet portion of the heat exchanger tube 40, a linear extent 65 of the heat exchanger tube is not of circular cross section. The portion 65 is of elliptical or egg-shaped cross section with the axis of the ellipse preferably oriented at a 45° angle with respect to the plane of the adjacent wall surface of the convection blower chamber 8. Neck up and neck down pipe sections 67 and 68 couple the elliptical cross section portion 65 of the heat exchanger tube 40 to the respective upstream and downstream sections of the heat exchanger. The elliptical cross section portion 65 provides an external surface area which is exposed to the air flowing from the convection blower wheels 19 and tends to draw the air flow over substantially the entire extent of such heat exchanger tube portion 65. This increases the cooling effect of such portion and increases thermal energy transfer to the air.

Referring now to the exhaust tube section 54, it initially is noted that in U.S. Pat. No. 4,484,561 the exhaust tube section was terminated at about the center of the blower wheel with side outlet openings facing the upper half region of the inlet opening of the blower wheel. Moreover, in the multiple blower embodiment disclosed in said patent, the exhaust tube section extended only to the uppermost blower wheel. According to the present invention, improved and more uniform heating has been obtained by the heat exchanger exhaust tube configuration illustrated in FIGS. 1–4.

As shown, the exhaust tube section 54 extends vertically downwardly in front of the inlets or inlet openings 70 of the blower wheels 19 which are vertically spaced apart in the illustrated embodiment. The inlet openings 70 are circular and the exhaust tube section is aligned with the vertical diameters of such inlet openings. As is typically the case the inlet opening 70 of each blower is coaxial with the rotational axis of the blower wheel.

Along its length the exhaust tube section 54 is provided with exhaust outlets 73 and 74. The outlets 73 and 74 are respectively disposed in front of the inlet openings 70 of blowers 17 and 18. As is preferred the exhaust outlets direct the combustion products towards a lower region of the inlet openings of the respective blowers. More particularly, flow of combustion products is directed towards the lowermost quarter segment of the inlet opening.

Figure 6:
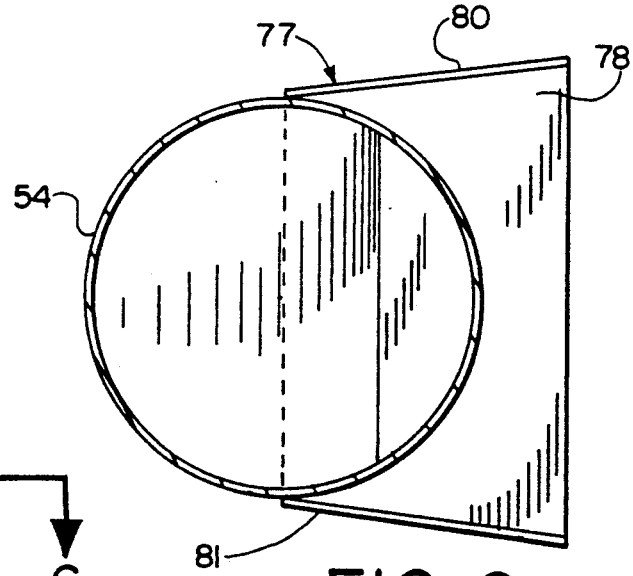
FIG. 6 is an enlarged partial sectional view taken along the line 6—6 of FIG. 5.
Figure 5:
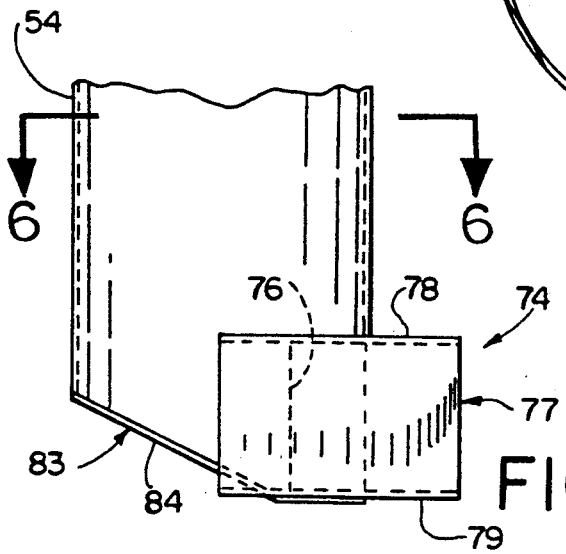
FIG. 5 is an enlarged partial elevational view taken from the line 5—5 of FIG. 1.

With additional reference to FIGS. 5 and 6, the lower outlet 74 is formed by an opening 76 in the side wall of the exhaust tube section 54 and annexhaust vent nozzle 77. As shown, the nozzle has parallel top and bottom walls 78 and 79 and outwardly flared side walls 80 and 81. The walls may be formed by plates welded to each other along adjacent edges and to the exhaust tube section around the perimeter of outlet opening 76. The nozzle 77 opens radially outwardly in a direction parallel to the rotational axis of the adjacent blower wheel 19 and the discharge end of the nozzle is located in close proximity to the plane of the front face of the blower wheel. The end of the exhaust tube section is closed off by a bottom plate 83. The bottom plate 83 preferably has an upwardly sloped rear portion 84 which assists in turning gas flow towards the outlet opening 76 for exiting through nozzle 77.

The upper outlet 73 is similarly formed by an opening in the side wall of exhaust tube section 54 and an exhaust vent nozzle 86. The opening and nozzle are essentially identical to the opening and nozzle of the lower outlet 74, although their relative sizes may be varied to provide for adjustment of exhaust flow through the outlets.

Figure 2:
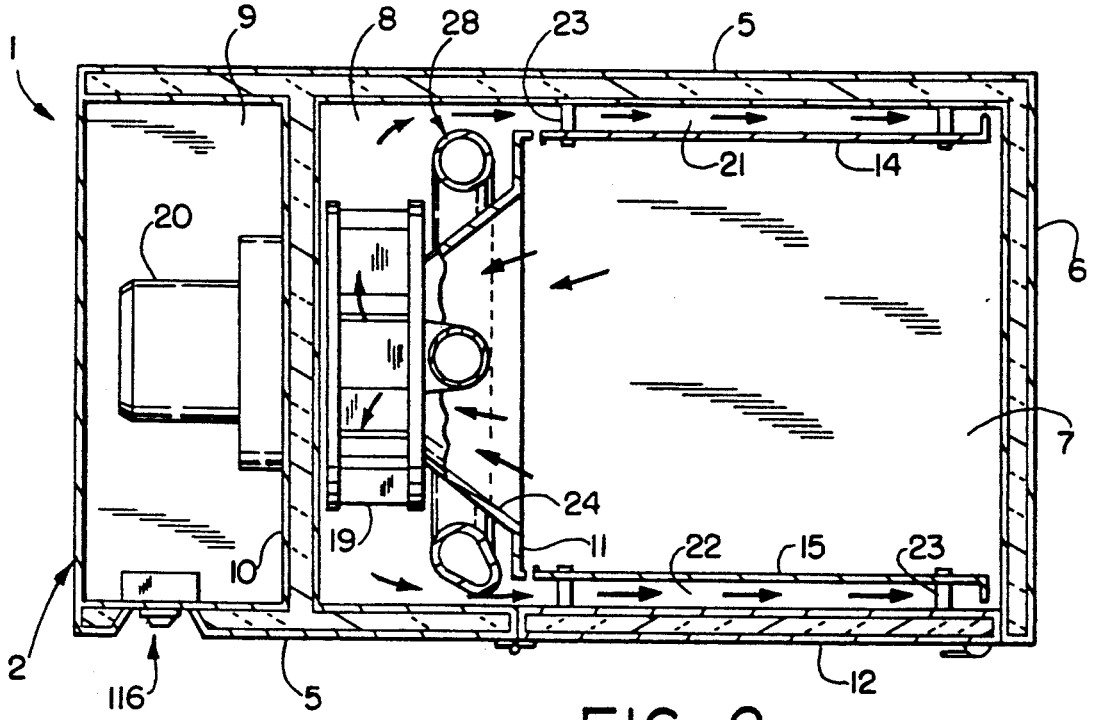
FIG. 2 is a sectional view taken along the line 2—2 of FIG. 1.
Figure 3:
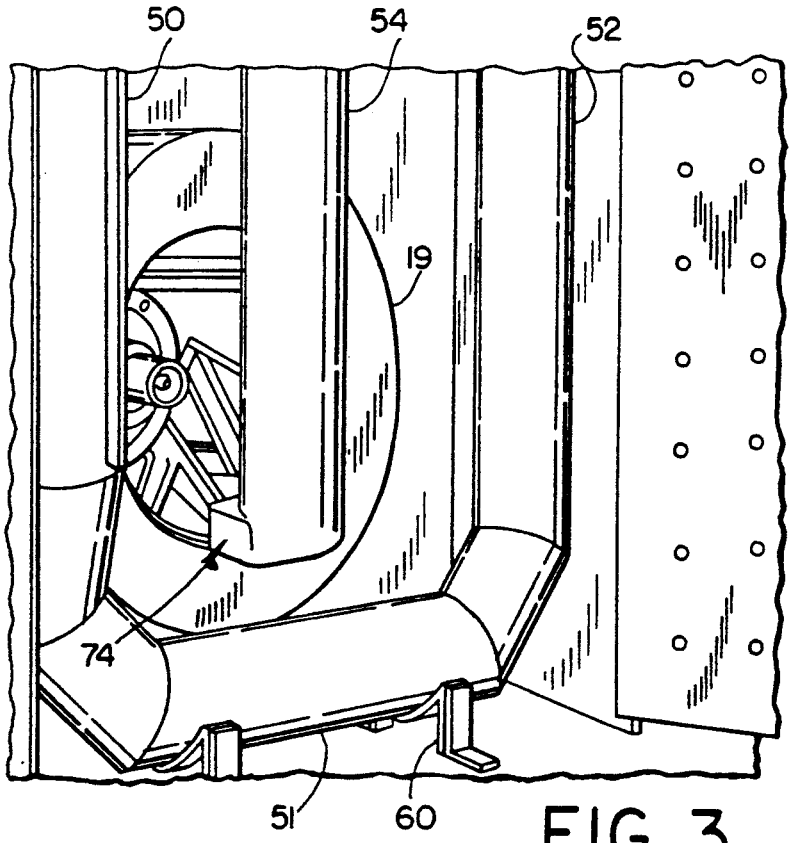
FIG. 3 is an enlarged partial perspective view of the convection blower/heat exchanger chamber with the inlet baffle and air filter removed.

Referring now to FIGS. 7–11 and also to FIG. 2, an improved baffle arrangement and configuration will now be described. The front and rear baffles 14 and 15 are essentially identical although mirror images of one another. Accordingly only the rear baffle is shown and described in detail for the sake of brevity.

As seen in FIGS. 7–11, the rear baffle 14 has a front wall 90, top wall 91, bottom wall 92 and end wall 93. At its end opposite end wall 93, the baffle has an inlet opening 94 defined by the edges of the front, top and bottom walls. Along its edge adjacent the opening 94 the front wall is provided with an outwardly directed lip flange 95. The lip flange is designed to closely overlap the side edge of the air inlet baffle 11 and, more particularly, the side edge of a filter disposed in the air inlet baffle.

Figure 4:
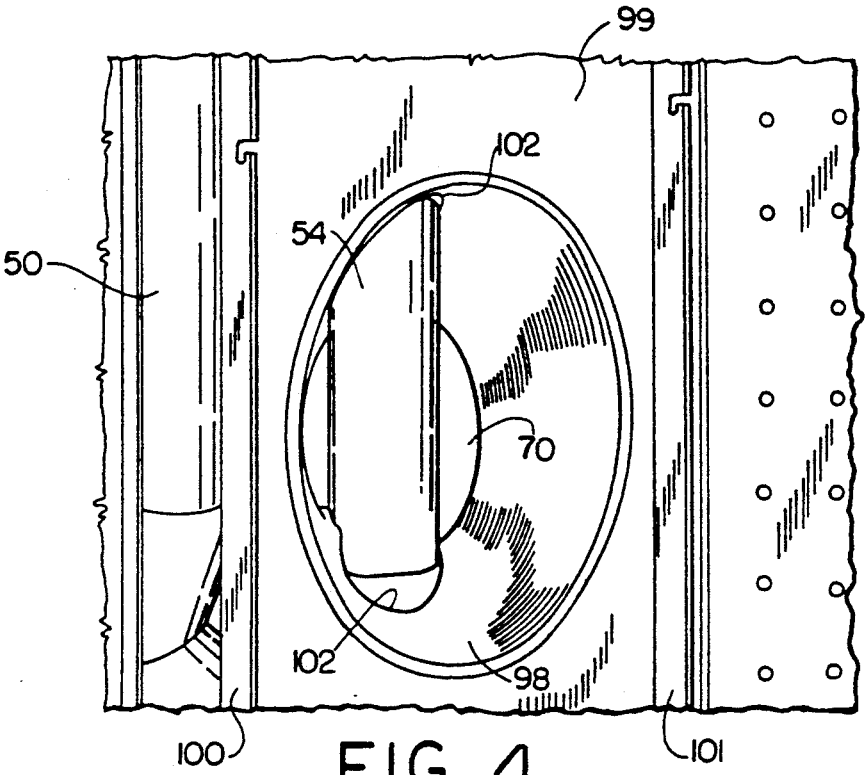
FIG. 4 is an enlarged partial perspective view of the convection blower/heat exchanger chamber with the inlet baffle installed.

Briefly referring to FIG. 4, each air inlet baffle 11 can be seen to have a conical central portion 98 coaxially aligned with the blower wheel inlet opening 70 and a planar wall portion 99 circumscribing the wider end of conical portion 98. The front and rear side edges of wall portion 99 are bent outwardly and perpendicularly to wall portion 99 to form side flanges 100 and 101. The side flanges and wall portion define a housing for a filter element which normally is used but is not shown. It further can be seen that the conical portion is provided with cut-outs 102 for passage of the exhaust vent section 54.

Figure 7:
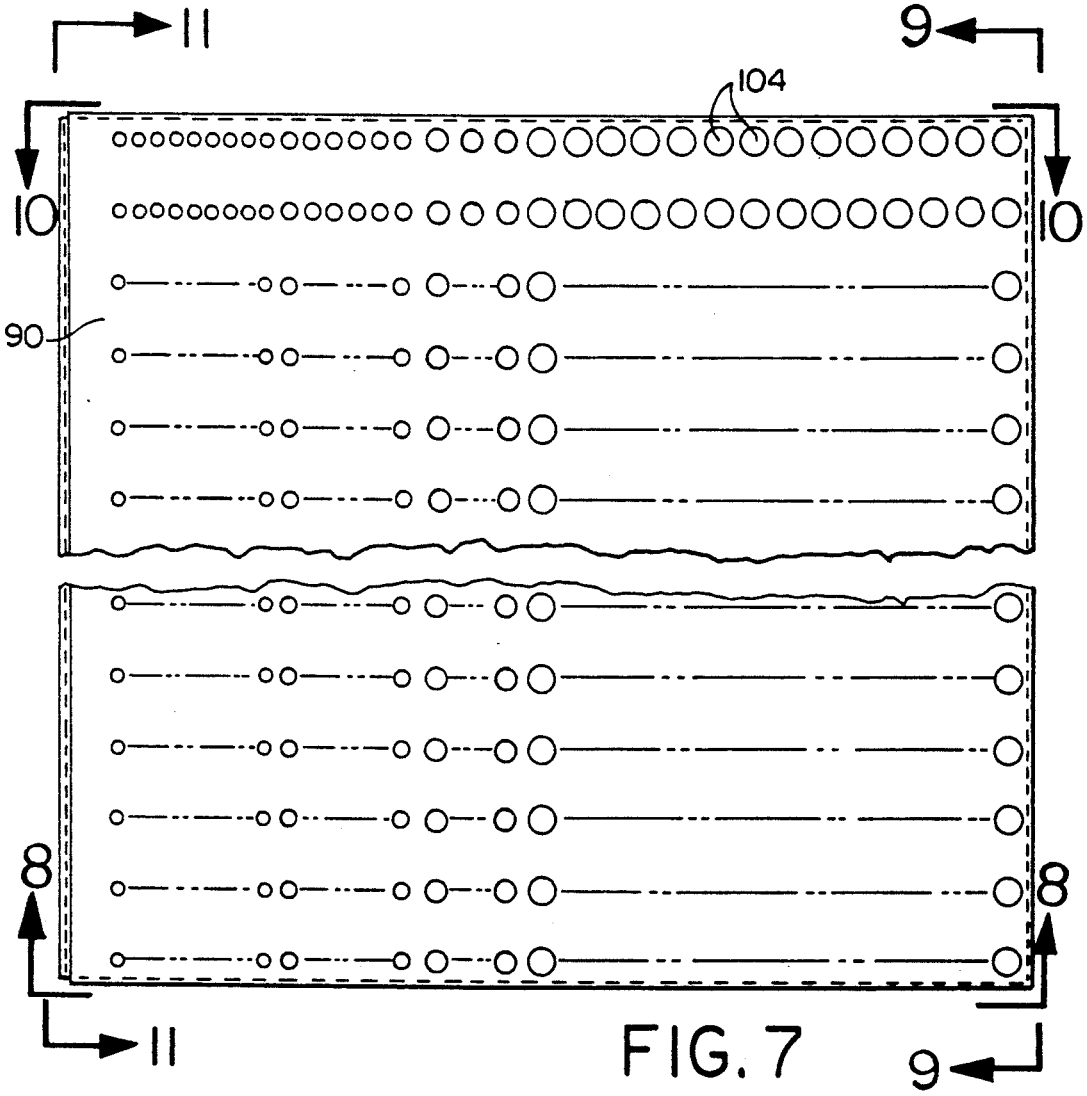
FIG. 7 is an elevational view of a baffle employed in the oven of FIG. 1.
Figure 8:
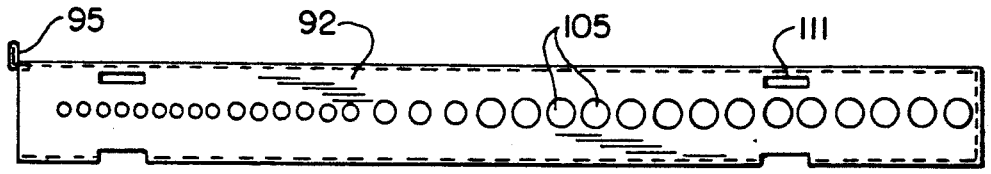
FIG. 8 is a bottom view of the baffle taken from the line 8—8 of FIG. 7.
Figure 11:
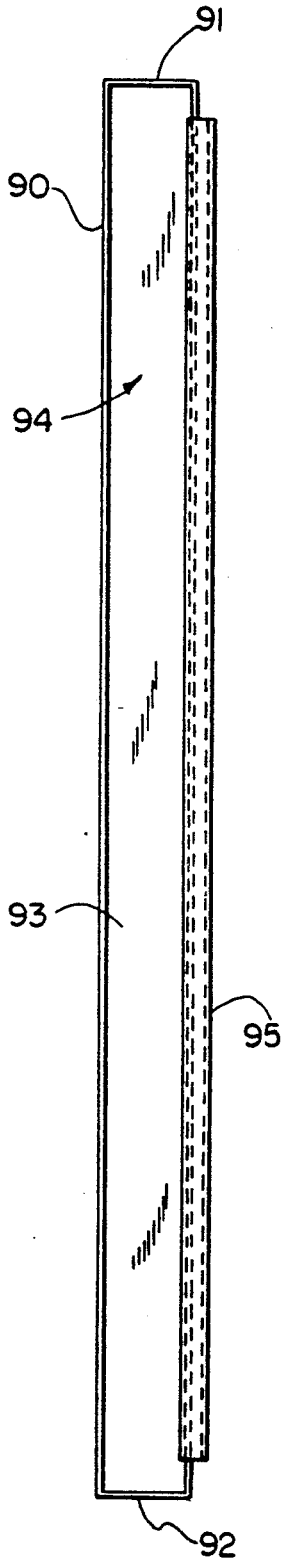
FIG. 11 is an elevational view of the other end of the baffle taken from the line 11—11 of FIG. 7.
Figure 9:
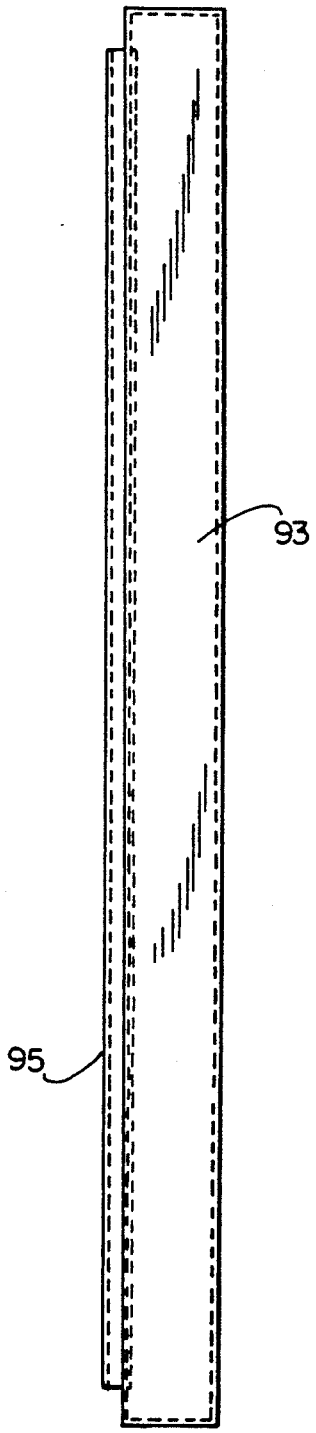
FIG. 9 is an elevational view of one end of the baffle taken from the line 9—9 of FIG. 7.

Turning back to the baffle 14, it can be seen in FIG. 7 that the front wall is provided with an array of openings 104. The openings are arranged in a plurality of horizontal rows which are uniformly and vertically spaced apart. The openings in each row are arranged in groups of progressively increasing size going away from the blowers, i.e., left to right in FIG. 7. In the illustrated embodiment, the number of holes remains the same while the cross-sectional size of the holes increases moving away from the inlet side of the baffle. An alternative arrangement would be to use holes of like size but increase the number of openings in each region moving away from the inlet side of the baffle. As seen in FIG. 8, a graduated row of openings 105 also provided in the bottom wall 92, but not in the top and end walls 91 and 93 as seen in FIGS. 9 and 10.

In relation to the baffle arrangement disclosed in the above noted U.S. Pat. No. 4,484,561, more uniform temperature distribution has been achieved by providing the baffle with end wall 93 which is operative to close off the remote end of air plenum 21. When the baffle is installed as shown in FIG. 2, the rear edge of the end wall 93 is located closely adjacent the rear wall 5 to prevent substantial flow of air around the end of the baffle. This is also the case with the top and bottom walls. Hence, most air directed from the blowers into the plenum must exit through the openings 104 and 105 in the front and bottom walls 90 and 92. The above mentioned graduated size and/or number of the openings 90 and 92 compensate for the progressive drop in air pressure in the plenum moving away from the blowers, thereby to provide for uniform distribution of heated air across the width of the heating compartment 7 interiorly of the baffles.

Figure 10:
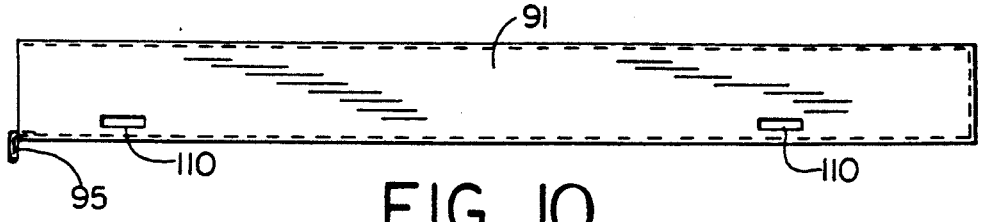
FIG. 10 is a top plan view of the baffle taken from the line 10—10 of FIG. 7.

As seen in FIG. 10, the top and bottom walls 91 and 92 have slots 110 and 111 for hanging from posts 23.

As seen in FIG. 1, an outlet stack of flue 112 allows hot air or other gases to exit the gas convection oven 1 in a controlled manner. The stack 112 may be located in position to pass up through the burner housing portion or compartment 26 and may be coupled to a conventional vent pipe.

The gas convection oven disclosed is well adapted to processing food, including thawing frozen foods and in addition to being used in the food service industry, may be used for other purposes as well. The side baffle plates 14 and 15 and the conical inlet baffle 11 are removably mounted for ease and convenience in cleaning the heating chamber 7 and convection blower chamber 8. Moreover, preferably an air filter,such as a metal filter, provided at the upstream end of the conical air inlet baffle 11 to remove particulate material from the circulating air. Moreover, if desired conventional means may be employed to provide moisture inlet to the heating chamber or convection blower chamber to maintain a desired humidity effect therein, as is well known in the art.

Controls 116 (FIG. 2) of conventional design may be provided adjacent the equipment chamber 9 for effecting monitoring and control of the various portions of the convection oven 1. Such controls may include the above mentioned thermostat as well as speed controls for the convection blowers 17 and 18.

STATEMENT OF INDUSTRIAL APPLICATION

In view of the foregoing it will be appreciated that the invention does provide means for effecting heating of food or other material in a heating chamber 7 in a relatively highly efficient and energy efficient manner.

We claim:

1. A convection oven, comprising a heating compartment, burner means for effecting combustion of gas, heat exchanger means for conducting therethrough the products of combustion of gas initiated at said burner means, first and second blower means for blowing air past said heat exchanger means and into said heating compartment for heating said compartment, said first and second blower means including first and second inlet means, respectively, for drawing air therethrough into said blower means from said heating compartment for recirculation past said heat exchanger means, and said heat exchanger means including first and second outlet means for directing said combustion products towards said first and second inlet means, respectively, and in a direction parallel to the intake direction of said first and second blower means, respectively, said first and second blower means being spaced apart along a common side of said heating compartment, said heat exchanger means including a tubular exhaust section spanning said inlet means of said first and second blower means, and said outlet means including repective openings in said tubular exhaust section.

2. The oven of claim 1, wherein each said outlet means directs the combustion products towards a lower region of the inlet means of the respective blower means.

3. The oven of claim 1, wherein each said outlet means further includes exhaust vent means for directing combustion products from the respective opening in said tubular exhaust section towards the inlet means of the respective blower means.

4. The oven of claim 3, wherein said exhaust vent means is outwardly flared.

5. The oven of claim 1, wherein said first and second blower means are located one above the other, and said tubular exhaust section of said heat exchanger means extends vertically in front of the inlet means of said first and second blower means.

6. The oven of claim 5, wherein said heat exchanger means comprises a tube including said tubular exhaust section and a pair of side sections relatively upstream of said exhaust section, said side sections extending generally parallel and proximate to respective vertical edges of said common side of said heating compartment.

7. The oven of claim 6, wherein said heating compartment has vertical walls extending generally perpendicular to said common side of said heating compartment, and further comprising respective baffles spaced inwardly from, and parallel to, said vertical walls and defining therewith air plenum chambers, and means for directing air passing over said side sections of said heat exchanger means into said plenum chambers, said baffles having therein a plurality of openings for passage of air from said plenums into an interior space located between said baffles, and said plenum chambers being substantially closed at their ends furthest from said heat exchanger means to restrict flow of air around said baffles at said ends furthest from said heat exchanger means.

8. The oven of claim 2, wherein each said blower means includes a rotatable impeller, said respective inlet means includes a circular opening coaxial with said impeller, and said respective outlet means is radially offset from the rotation axis of said impeller.

9. A convection oven, comprising a heating compartment, burner means for effecting combustion of gas, heat exchanger means for conducting therethrough the products of combustion of gas initiated at said burner means, blower means for blowing air past said exchanger means and into said heating compartment for heating said compartment, said blower means including inlet means at one side of said heating compartment for drawing air into said blower means from said heating compartment for recirculation past said heat exchanger means, said heating compartment having vertical walls extending generally perpendicular to said one side of said heating compartment, respective baffles spaced inwardly from, and parallel to, said vertical walls and defining therewith air plenum chambers, and means for directing air passing over said heat exchanger means into said plenum chambers, said baffles having therein a plurality of openings for passage of air from said plenums into an interior space located between said baffles, said plenum chambers being substantially closed at their ends furthest from said heat exchanger means to restrict flow of air around said baffles at said ends furthest from said heat exchanger means, said heat exchanger means comprising a tube including a tubular exhaust section and a pair of side sections relatively upstream of said exhaust section, said side sections extending generally parallel and proximate to respective vertical edges of said one side of said heating compartment, said blower means including first and second blowers vertically spaced apart along said one side of said heating compartment, said inlet means including first and second inlets corresponding respectively to said first and second blowers, and said tubular exhaust section spanning said inlets of said first and second blowers and having outlets respectively disposed in front of said inlets.

10. The oven of claim 9, wherein each said blower means includes a rotatable impeller, said inlet means includes a circular opening coaxial with said impeller and centrally disposed in relation to said baffles.

11. A convection oven, comprising a heating compartment, burner means for effecting combustion of gas, heat exchanger means for conducting therethrough the products of combustion of gas initiated at said burner means, blower means for blowing air past said heat exchanger means and into said heating compartment for heating said compartment, said blower means having an inlet through which air is drawn into said blower means from said heating compartment for recirculation past said heat exchanger means, and said heat exchanger means including oulet means for directing said combustion products towards a lower region of the inlet of the blower means and in a direction substantially parallel to the intake direction of said blower means, said heat exchanger means including a tubular exhaust section, and said outlet means including exhaust vent means for directing combustion products from an opening in said tubular exhaust section towards the inlet of the blower means.

12. The oven of claim 11, wherein said exhaust vent means is outwardly flared.

13. The oven of claim 11, wherein said heat exchanger means comprises a tube including said tubular exhaust section and a pair of side sections relatively upstream of said exhaust section, said side sections extending generally parallel and proximate to respective vertical edges of said heating compartment.

14. A convection oven, comprising a heating compartment, burner means for effecting combustion of gas, heat exchanger means for conducting therethrough the products of combustion of gas initiated at said burner means, and first and second blower means for blowing air past said heat exchanger means and into said heating compartment the heating said compartment; said first and second blower means each having an inlet through which air is drawn into said blower means from said heating compartment for recirculation past said heat exchanger means; said heat exchanger means including a tubular exhaust section spanning said inlets of said first and second blower means; said tubular exhaust section having first and second outlets for said combustion products respectively disposed in front of said inlets of said first and second blower means; said tubular exhaust section having a width less than the width of said inlets.

15. The oven of claim 14, wherein said heat exchanger means further includes a pair of side sections upstream of said tubular exhaust section.

16. The oven of claim 15 wherein one of said side sections includes an inlet at its upper end communicating with said burner means.

17. The oven of claim 16, wherein each said outlet is located to direct the combustion products towards a lower region of the inlet of the respective blower means.

18. The oven of claim 14 wherein said burner means is located above said heating compartment.

* * * * *